United States Patent [19]

Auker

[11] Patent Number: 4,989,585

[45] Date of Patent: Feb. 5, 1991

[54] HAND MANIPULATED ROLLER MASSAGE TOOL

[76] Inventor: Lawrence F. Auker, 10302 Kerrigan St., Santee, Calif. 92071

[21] Appl. No.: 332,671

[22] Filed: Apr. 3, 1989

[51] Int. Cl.[5] ..... A61H 15/00

[52] U.S. Cl. ..... 128/57; 128/44

[58] Field of Search ..... 128/57, 44, 67; 15/104 R; 366/129

[56] References Cited

U.S. PATENT DOCUMENTS

| | | | |
|---|---|---|---|
| 259,456 | 6/1882 | Angstrom | 128/57 |
| 579,719 • | 8/1924 | Néede Lombardon | 128/57 |
| 1,509,659 | 7/1924 | Suddard | 15/104 R |
| 1,530,716 | 3/1925 | Doerr | 366/129 |
| 1,536,162 | 4/1925 | Suddard | 15/104 R |
| 1,886,544 | 11/1932 | Hemp | 128/57 |
| 2,011,471 | 8/1935 | Casagrande et al. | 128/57 |
| 2,168,842 | 8/1939 | Kestevan et al. | 128/57 |
| 2,246,263 | 6/1941 | Patterson | 128/57 |
| 2,286,324 | 6/1942 | Wentz | 128/57 |
| 2,515,524 | 7/1950 | Manzel | 128/57 |
| 2,621,652 | 12/1952 | Ehrhardt | 128/57 |
| 2,633,844 | 4/1953 | Herndon | 128/57 |
| 2,691,978 | 10/1954 | Kirby | 128/57 |
| 3,060,928 | 10/1962 | Lowe | 128/57 |
| 3,858,579 | 1/1975 | Ching | 128/57 |
| 4,374,519 | 2/1983 | Stauft | 128/57 |
| 4,433,683 | 2/1984 | McCory et al. | 128/57 |
| 4,554,911 | 11/1985 | Nielson | 128/57 |
| 4,621,622 | 11/1986 | Beck | 128/57 |
| 4,622,956 | 11/1986 | Nesheim | 128/57 |

*Primary Examiner*—Edgar S. Burr
*Assistant Examiner*—Lisa E. Malvaso

[57] ABSTRACT

The disclosure is directed to two different embodiments of a roller massage tool. In one embodiment a "Y" shaped body includes a handle with a rotatable shaft extending between the adjacent distal ends of the "Y" and a rotatable handle member positioned on the single leg of the "Y". The rotatable shaft carries a pair of resilient non-rotatable balls thereon. In use the balls are rotated against the portion of the users body for massaging that portion. The device may be suspended by a rope or the like to a fixed object and the user can rub a portion of their body against the resilient balls. In the other embodiment a straight shaft extends through the diameter of the resilient balls. The resilient balls are centered and fixedly positioned on the shaft and rotatable handles are positioned on each distal end of the shaft. This second embodiment operates in the same manner as the first and is generally used with both hands rather than one as in the first embodiment.

4 Claims, 2 Drawing Sheets

HAND MANIPULATED ROLLER MASSAGE TOOL

BACKGROUND OF THE INVENTION

The invention is directed to massage devices and more particularly to hand held resilient ball type massage devices. Various types and configurations of hand held massage devices are known in the art. Some examples of these prior art devices are as follows:

U.S. Pat. Nos. 1,886,544; 2,011,471; 2,168,842; 2,621,652; 2,633,844; 2,691,978; 3,060,928; 4,374,519 and 4,554,911 generally teach hand held massage devices in which the resilient or non-resilient rollers rotate independent of each other and the handles are fixed in position, i.e. non-rotatable.

U.S. Pat. No. 2,246,263 teaches a hand implement that has a fixed in position handle and a split shaft for containing the rollers which rotate independently of each other.

U.S. Pat. No. 2,286,324 teaches a massage roller with independently mounted rollers and freely rotatable handles. The handles can be translated toward the rollers to bind up the rotation of the rollers and handles. The handles cannot rotate freely when the rollers rotate together.

U.S. Pat. No. 4,433,683 teaches a exercise-massaging device that binds the handles and rollers together in its normal configuration and requires compressing the handle springs to disengage the handles from the rollers. The handles are not rotatable relative to the central shaft 4.

These devices are hard to manipulate, do not apply even pressure over the body area covered, are not sufficiently or solid in construction and, therefore, do not apply suitable massage action over the body areas covered thereby.

There has not been a simple and effective hand manipulated massage device until the emergence of the present invention.

SUMMARY

The present invention is directed to a hand held and manipulated massage device which includes in one embodiment a pair of resilient spheres fixedly mounted together on a common shaft rotatably held in place between the distal ends of a "Y" shaped body member with the single leg of the "Y" having a rotatable handle thereon whereby the spheres rotate together and the handle rotates relative to the body member.

A second embodiment has a straight rigid shaft with two abutted spheres fixedly attached to the central portion thereof and rotatable handle members on each end thereof for relative rotation therewith.

In operation, the massage device of the invention can be rolled over areas of the human body for physical therapy thereto. The device can be used by anyone to locate and treat areas that are a problem and will respond only to physical therapy such as neuro-muscular disease, arthritis, muscle spasms, etc. The roller massage unit is designed for individual use if desired or by one person for use on another person. Two separate embodiments are shown and described. One embodiment is for single hand use and the other is for two hand use.

An object of this invention is to provide a roller massage device in which a pair of rollers formed of selectively resilient material rotate together when applied to a body area of a person.

Another object of this invention is to provide at least one handle on the massage device which rotates relative to a "Y" shaped frame member of the device.

Still another object of this invention is to provide a frame member on which the resilient rotatable spheres rotate relative to a pair of handles adjacent thereto.

Yet another object of this invention is to provide resilient spheres for application to areas of the human body which can have various selected different resiliency.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENTS OF THE INVENTION

Figure 1:
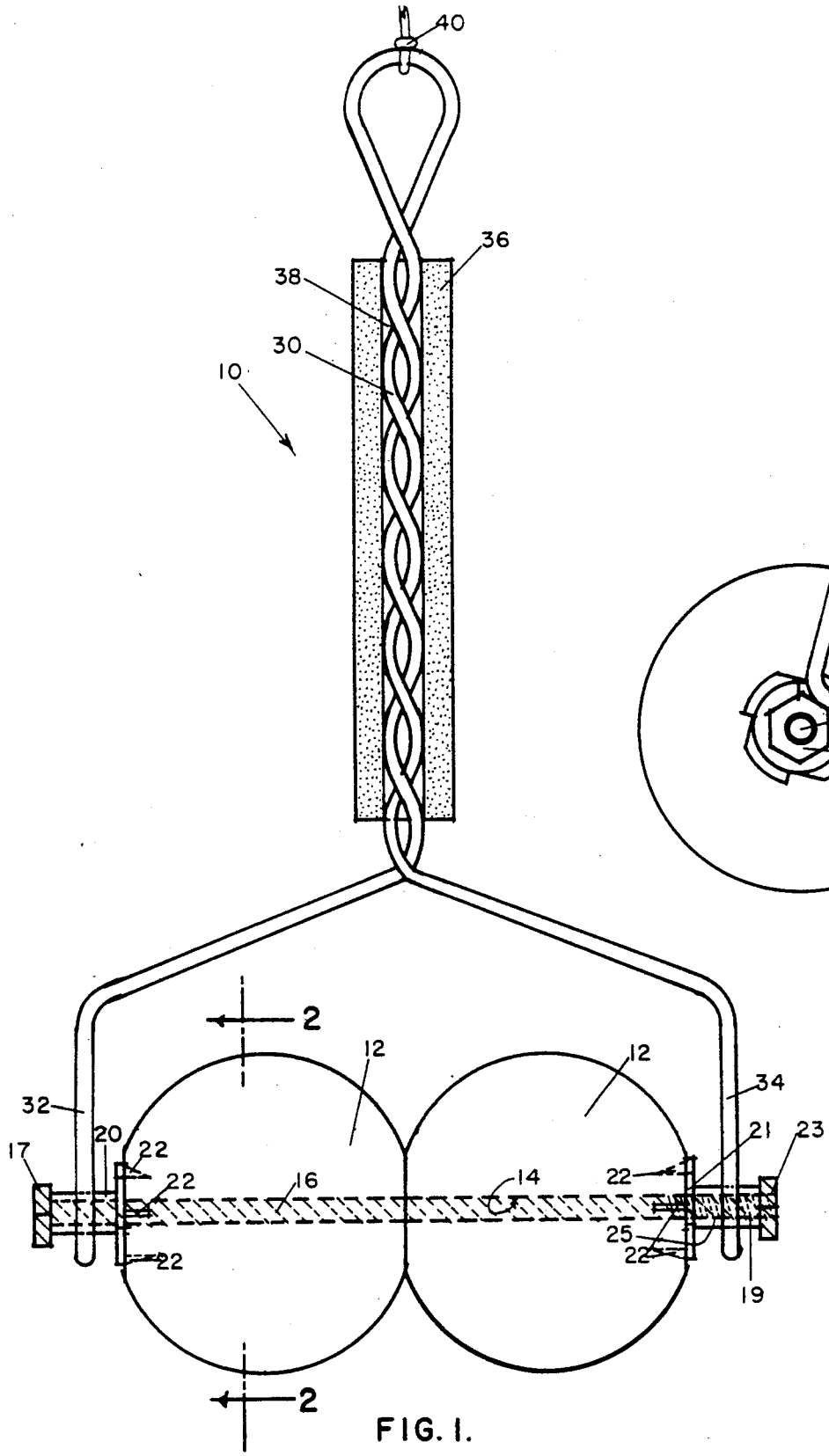
FIG. 1 depicts a first embodiment of the massage device of the present invention.
Figure 2:
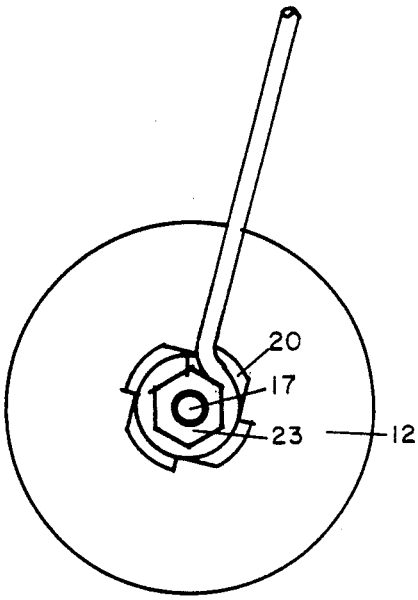
FIG. 2 is a showing of FIG. 1 taken along line 2—2.

Referring now to the drawing FIGS. and particularly to drawing FIGS. 1 and 2 which depict one embodiment of my massage device 10 for use with one hand. Semi-solid spheres 12 which are interchangeable with different like spheres having different selected resiliencies, i.e. more or less, resiliency, as desired. The spheres 12 are drilled forming a bore 14 through their diameters. The bores of the spheres are then strectched over a shaft 16 which has a diameter larger then the diameter of the bores so that the bores form a tight fit over the shaft to make the device more solid in the hub area, more durable and to prevent relative rotation between the shaft and spheres. The shaft 16 is a ¼ inch-20 steel bolt or the like with an enlarged head 17 at one end and threads 19 on the other end and in the embodiment shown is approximately 5 ½inches long and serves as a support shaft for the spheres and handle. Flanged sleeves 20 and 21 have sharp prongs 22 which penetrate through the surface of the spheres 12 and threaded end of the shaft. Flanged sleeve 20 has a slip fit over shaft 16 and abuts the enlarged head 17. Flanged sleeve 21 has internal threads 25 which mate with like threads 19 on the end of shaft 16. Flanged sleeve 21 when threaded toward the adjacent sphere 12 causes the spheres to be forced together to provide adjustment of the resiliency of the spheres and assure that the spheres and shaft rotate as a single unit. A nut 23 is likewise threaded over the threads 19 to a position which abuts and locks the sleeve 21 in a selection position on shaft 16. Flanged sleeves 20 and 21 squeeze the spheres 12 together at their abutting surfaces to assure that the spheres and shaft roll as a single unit.

The nut 23 can be adjusted on the threads 19 to exert more or less pressure on the sphere 12 to make them more or less firm for durability and a slight change in their flexibility which are new and essential features of the device 10. Prongs 22 on the flanged sleeve 20 and the lock nut 23 assure spheres and shaft unitary rotation. The lock nut 23 is a ¼-20 hex nut. These above referenced parts are standard and available in most hardware stores. The assemblage of the above elements and their adjustable resiliency are the new and essential features of this invention, i.e. The normal expected resiliency of the spheres can be slightly firmed by threading the flanged sleeve toward the enlarged head 17.

A twisted handle body 30, as are the upper arms of the "Y", is formed from 0.160 diameter steel wire. The steel wire at the handle is twisted and formed as shown in the drawing FIG. 1. The distal ends 32 and 34 of the "Y" shaped body are formed to fit freely over the sleeves 20 and 21 so that any wear encountered during rotation of the sleeve and spheres is metal to metal. A hand rotatable grip 36 constructed as shown in drawing FIG. 1 can be constructed of wood, plastic or fiber. The twisted handle body 30 is placed inside of a bore 38 in the grip 36. The grip shown is constructed from a section of round wood dowel approximately ¾ inches in diameter. A cord 40 may be attached for positioning the device behind the back of the user while using a wall or door surface to apply pressure as the user leans into the device 10.

Figure 4:
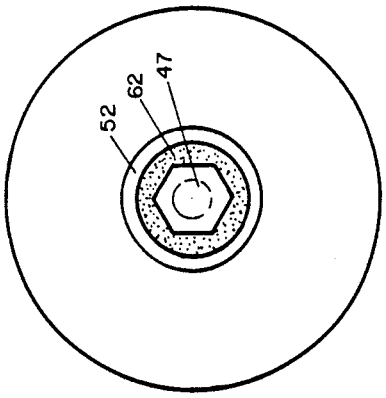
FIG. 4 is showing of FIG. 3 taken along line 4—4.
Figure 3:
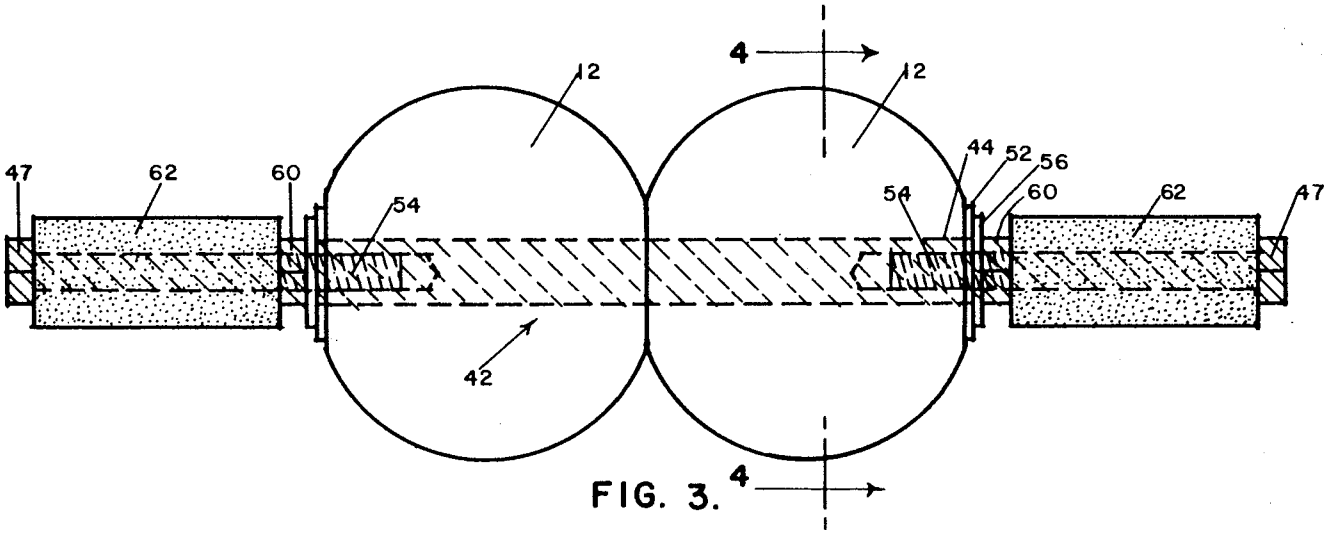
FIG. 3 depicts the a second embodiment of the massage device of the present invention.
Figure 5:
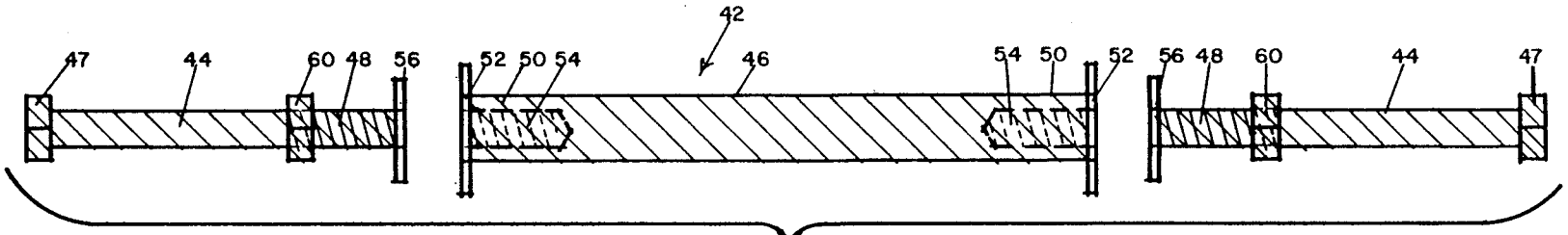
FIG. 5 is a showing of the second embodiment of the massage device with the handles and spheres removed.

In a second embodiment shown in drawing FIGS. 3, 4 and 5 the central shaft 42 is formed by two end segments 44 and central segment 46. The end segments 44 have an enlarged head 47 at one end and are threaded on end 48. The distal ends 50 of the central segment 46 include an enlarged flange 52 and internal threads 54 which mate with threaded ends 48 of segments 44 when assembled as shown in drawing FIG. 3. The central segment 46 is a 7/16 inch diameter aluminum bar stock cut and faced to 4.40 inches in length, drilled and threaded ¼-20 μinch deep on each end. The spheres 12 are drilled and stretched over the central segment 46 as discussed in the first embodiment above. A pair of sphere containment washers 52 and a pair of retainer washers 56 that fit over the end segments 44 and against the distal ends of the central segment and spheres. After the end segments are threaded into the central segment with the washers in place a pair of ¼-20 lock nuts 60, one on each end adjacent to central segment 46, lock the segments together when the segments 44 are threaded into central segment 46. The end segments are formed from ¼-20 steel bolts 2.50 inches in length. A grip 62 formed in the same manner as the grip of the first embodiment is placed over the end segments prior to assembling the various components. After assembly the grips rotate relative to the spheres.

While specific embodiments of a hand held massage unit have been shown and fully explained above for the purpose of illustration it should be understood that many alterations, modifications and substitutions may be made to the instant invention disclosure without departing from the spirit and scope of the invention as defined by the appended claims.

What is claimed is:

1. A hand held massage device comprising:

a "Y" shaped body portion, having two legs terminating in free ends formed as eyes to form a gap therebetween, a single stem, a shaft connecting said free ends and received in said eyes, a pair of resilient spheres positioned on said shaft across the gap of the "Y" which rotate together relative to the "Y" shaped body portion and a handle grip member surrounding the single stem of the "Y" shaped body, said handle grip member being rotatable relative to said "Y" shaped body member.

2. The invention as defined in claim 1 wherein said body portion is formed from a continuous length of steel rod.

3. The invention as defined in claim 1 wherein said resilient spheres have various selected degrees of resiliency.

4. A hand held massage device comprising:

a central shaft segment, a pair of abutted resilient spheres fixed in position on said central shaft segment; a pair of end shaft segments one of which threadedly engages each end of said central shaft segment; the diameter of said central shaft segment being greater than the diameter of said end shaft segments; and a rotatable handle grip rotatably positioned on each one of said pair of end shaft segments for relative rotation therewith whereby when said spheres are rolled across a body area of a person said hand grips do not rotate therewith.

* * * * *